US006818271B2

(12) United States Patent
Fearn et al.

(10) Patent No.: US 6,818,271 B2
(45) Date of Patent: Nov. 16, 2004

(54) ADHESIVE COATED THIN FILM LABEL

(75) Inventors: Richard Fearn, Milford, OH (US); Richard Spear, Cincinnati, OH (US)

(73) Assignee: Spear USA, LLC, Mason, OH (US)

( * ) Notice: Subject to any disclaimer, the term of this patent is extended or adjusted under 35 U.S.C. 154(b) by 0 days.

(21) Appl. No.: 10/166,276

(22) Filed: Jun. 10, 2002

(65) Prior Publication Data

US 2003/0152722 A1 Aug. 14, 2003

Related U.S. Application Data

(60) Provisional application No. 60/356,283, filed on Feb. 12, 2002.

(51) Int. Cl.[7] ..... B42D 15/00

(52) U.S. Cl. ..... 428/40.1; 283/81; 428/41.3; 428/41.5; 428/42.1; 428/42.2; 428/42.3; 428/43; 428/213; 428/216; 428/220; 428/354

(58) Field of Search ..... 428/40.1, 41.3, 428/41.5, 42.1, 42.2, 42.3, 43, 213, 216, 354, 41.8, 220, 343; 283/81

(56) References Cited

U.S. PATENT DOCUMENTS

| | | | | |
|---|---|---|---|---|
| 4,977,006 A | | 12/1990 | Smith et al. | 428/42 |
| 5,116,452 A | | 5/1992 | Eder | 156/566 |
| 5,306,375 A | | 4/1994 | Leonard | 156/249 |
| 5,366,251 A | | 11/1994 | Brandt et al. | 283/81 |
| 5,421,933 A | | 6/1995 | Nedblake et al. | 156/249 |
| 5,427,849 A | * | 6/1995 | McClintock et al. | 428/353 |
| 5,464,495 A | | 11/1995 | Eder | 156/456 |
| 5,486,253 A | | 1/1996 | Otruba | 156/215 |
| 5,487,807 A | | 1/1996 | Nedblake et al. | 156/353 |
| 5,491,010 A | | 2/1996 | Eder | 428/35.7 |
| 5,516,393 A | | 5/1996 | Freedman | 156/229 |
| 5,585,193 A | | 12/1996 | Josephy et al. | 428/515 |
| 5,624,520 A | | 4/1997 | Nedblake et al. | 156/249 |
| 5,679,199 A | | 10/1997 | Nedblake et al. | 156/254 |
| 5,681,412 A | | 10/1997 | Nedblake et al. | 156/184 |
| 5,709,937 A | | 1/1998 | Adams et al. | 428/332 |
| 5,711,839 A | | 1/1998 | Dronzek, Jr. | 156/277 |
| 5,741,381 A | | 4/1998 | Dolence et al. | 156/64 |
| 5,843,549 A | | 12/1998 | Mingus | 428/40.1 |
| 5,858,168 A | | 1/1999 | Hinton | 156/566 |
| 5,861,201 A | | 1/1999 | Blackwelder et al. | 428/36.91 |
| 5,902,449 A | | 5/1999 | Moore | 156/541 |
| 5,982,284 A | | 11/1999 | Baldwin et al. | 340/572.8 |
| 5,985,075 A | | 11/1999 | Freedman | 156/229 |
| 6,024,830 A | | 2/2000 | Nedblake et al. | 156/353 |
| 6,074,747 A | | 6/2000 | Scholz et al. | 428/352 |
| 6,083,620 A | | 7/2000 | LaPrade et al. | 428/355 R |
| 6,099,927 A | | 8/2000 | Freedman | 428/40.1 |
| 6,210,524 B1 | | 4/2001 | Josephy | 156/344 |
| 6,270,871 B1 | | 8/2001 | Scholz et al. | 428/40.1 |
| 6,299,956 B1 | | 10/2001 | Freedman | 428/41.8 |

FOREIGN PATENT DOCUMENTS

| | | | |
|---|---|---|---|
| EP | 0 275 670 | 7/1988 | B31D/1/02 |
| WO | WO 97/30844 | 8/1997 | B32B/7/12 |
| WO | WO 00/13888 | 3/2000 | B32B/7/12 |

OTHER PUBLICATIONS

Enlow et al., *Extrusion Coating Process for Making High Transparency Protective and Decorative Films*, US 2002/0007903 A1, Publication Date Jan. 24, 2002, Filed Jul. 2, 2001.

Nandy et al., *Clear and Opaque Labels and Methods and Systems for Producing Clear or Opaque Label Stock Laminated with Pressure–Sensitive Adhesive*, US 2001/0030020 A1, Publication Date Oct. 18, 2001, Filed Mar. 21, 1999.

Scholz et al., *Overlaminated Pressure–Sensitive Adhesive Construction*, US 2002/0041945 A1, Publication Date Apr. 11, 2002, Filed Aug. 7, 2001.

* cited by examiner

*Primary Examiner*—Nasser Ahmad
(74) *Attorney, Agent, or Firm*—Graydon Head & Ritchey LLP

(57) ABSTRACT

An adhesive coated thin film label and a method for applying a thin film label to a substrate. The thin film label has a thickness less than 1.0 mil and is die cut to define a label shape. The label includes visible indica and adhesive is applied to one side of the label film for bonding to the substrate. The label may further be provided in roll form mounted on a release liner.

12 Claims, 2 Drawing Sheets

ADHESIVE COATED THIN FILM LABEL

Pursuant to 37 C.F.R. § 1.78(a)(4), this application claims the benefit of and priority to prior filed co-pending Provisional Application Ser. No. 60/356,283, filed Feb. 12, 2002, which is expressly incorporated herein by reference.

FIELD OF THE INVENTION

This invention relates to labels for containers, and more particularly to adhesive coated thin film labels.

BACKGROUND OF THE INVENTION

Printed labels are widely used on containers to identify the particular products, manufacturers and brand names associated with the products in those containers. Conventional paper labels have been widely used for many years, however paper labels suffer several drawbacks, such as susceptibility to abrasion and poor adhesion in wet or moist conditions. An increasingly popular means of labeling containers has been through the use of pre-printed thin film labels. Thin film labels are made from a web of polymeric material printed with desired indica and applied to containers with an adhesive. These thin film labels provide a printed-on look to the containers to which they are applied and result in a label which is generally more durable than conventional paper labels. Thin film labels are generally die cut from the web of polymeric material to define a discrete label shape and are often provided on a web of carrier material such as a release liner.

It is desirable to make thin film labels from as thin a film as possible. Thinner films increase the aesthetic appearance of the labels, reduce overall material costs, and improve efficiency in the label application process. For example, as the thickness of the film is decreased, more labels may be supplied on a length of release liner which is to be wound into a given size roll. Conventional thin film labels generally have been made with thicknesses in the range of 2 to 3 mils, or even greater. It has long been desired to decrease the thickness of thin film labels to less than about 1 mil. However prior attempts to produce and apply labels less than about 1 mil in thickness in production environments have heretofore been unsuccessful.

While thin labels are desirable, they also create problems, particularly in the manufacture of the labels and the application of the labels to their respective containers. Very thin film labels exhibit relatively low stiffness, whereby attempts to dispense very thin film labels having a thickness of about 1 mil or less, from conventional peel tip equipment have been unsuccessful. Thinner labels also introduce durability issues into automated label application processes. Because the automated processing equipment used to package containers to which the labels will be applied are often run at high speeds, the labels must be applied to the containers at speeds which are sufficiently similar to the speed of the processing equipment. Such high speed application requirements often cause very thin film labels to stretch or split during the application process. The use of very thin films for labels stock also makes it difficult to die cut individual labels from the web of film stock without cutting through the carrier web of release liner.

There is thus a need for a very thin film label which may be applied to containers in high speed production lines, and which overcomes problems of prior art thin film labels, such as those described above.

SUMMARY OF THE INVENTION

The present invention provides a thin film label having a thickness in the range of 0.1 mil to 1.0 mil, which may be applied to substrates, such as glass or plastic bottles, or other containers. The label may be dispensed from conventional peel tip equipment to a desired container at production line speeds without damaging the label. The label may be die cut from a web of polymeric material with an adhesive on one side of the label film for bonding to the substrate.

In one aspect of the invention, multiple labels may be supplied on a web of release material for convenient dispensing in a packaging production line. It has been discovered that use of a low release value on very thin film labels will cause the labels to dispense from a peel tip when the labels have been "stiffened" by applying ink in the form of graphics on the labels. The release value of the adhesive acts in conjunction with the tension and speed of the web of liner material to dispense the thin film labels to a substrate as the liner web passes over a peel tip.

In another aspect of the invention, an exemplary thin film label may be made by forming a laminate from an elongate web of thin film, a web of release liner, and adhesive disposed between the film and release liner. Visible indica are applied to the film and the film is die cut to define discrete label shapes and a matrix of waste film. The matrix is stripped from the laminate, leaving the discrete thin film labels on the web of release liner.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
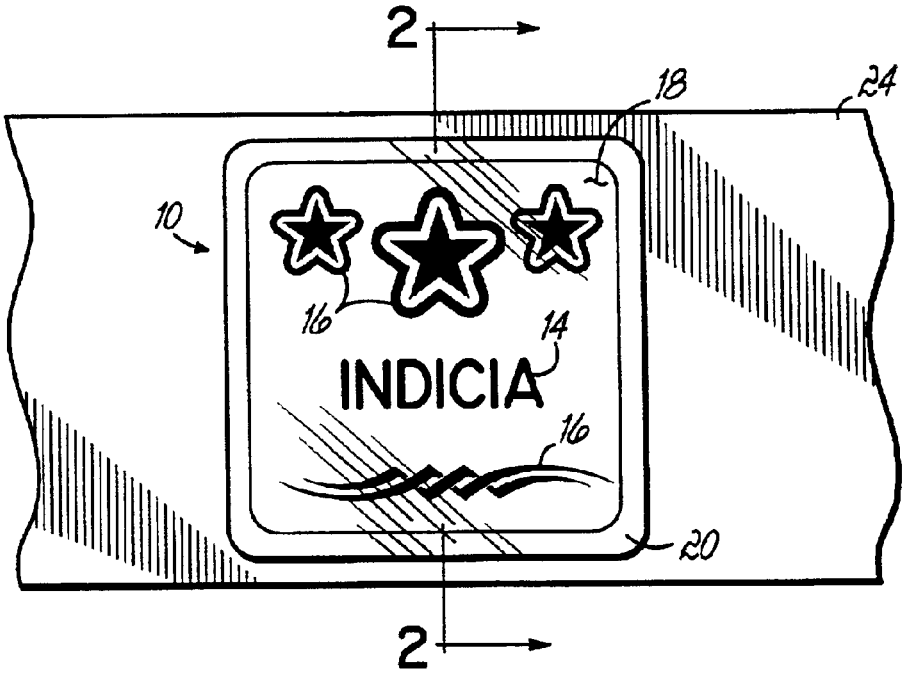
FIG. 1 is a plan view of an exemplary thin film label of the present invention.
Figure 2:
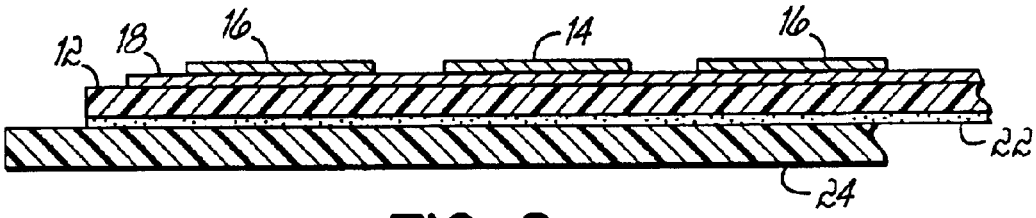
FIG. 2 is a partial cross-sectional view of the thin film label of FIG. 1, taken along line 2—2.

Referring to FIGS. 1 and 2, there is shown an exemplary adhesive coated thin film label 10 according to the present invention. The label 10 includes a very thin label film having a thickness of approximately 0.1 mil to approximately 1.0 mil. The label is die cut to a desired shape and further includes visible indica 14, 16 selectively applied to the label film 12 to create letters, numbers, decorative designs, or any combination thereof. The visible indica 14, 16 may be created, for example, by applying ink, hot stamped foil, or embossed images to the label film 12.

In the exemplary label shown in FIG. 1, the label includes an opaque printed area 18 defining a background and decorative designs 16 and indica 14 printed on top of the background. The background 18 does not cover the entire label surface and therefore the label 10 has a border 20 which comprises only the label film 12. In an exemplary embodiment, the label film 12 is clear, however the label film 12 may be manufactured to have any color desired. For example, the label film 12 may be manufactured to have an opaque, white color which gives the look of a paper label, while retaining the advantages of thin film labels.

The label 10 further includes an adhesive 22 applied to one side of the label film 12, for securing the label 10 on a substrate, such as a container. The adhesive 22 may be pressure sensitive adhesive, heat activated adhesive, water activated adhesive, or any other type of adhesive suitable for securing the label on a substrate. In an exemplary embodiment, the adhesive 22 is a pressure sensitive acrylic adhesive. In another exemplary embodiment, the adhesive 22 has a release value not greater than 15 g, as measured in a TMI release tester according to a modified FINAT test method, wherein a two-inch wide sample is pulled through an angle of 180 degrees at 1200 inches per minute. This release value is lower than release values typically used for such labels. The visible indica 14, 16 may be applied to either side of the label film 12 to produce a desired effect. For example, the visible indica 14, 16 may be applied as a reverse image on the same side of the label film 12 that the adhesive 22 is applied, whereby the image may be viewed through the label film 12 after the label 10 has been applied to a container.

In an exemplary embodiment, the thin film label 10 further includes a release liner 24 applied to the adhesive side of the label film 12. The release liner 24 protects the adhesive 22 and prevents premature bonding of the adhesive 22 prior to application on a desired container.

Figure 3:
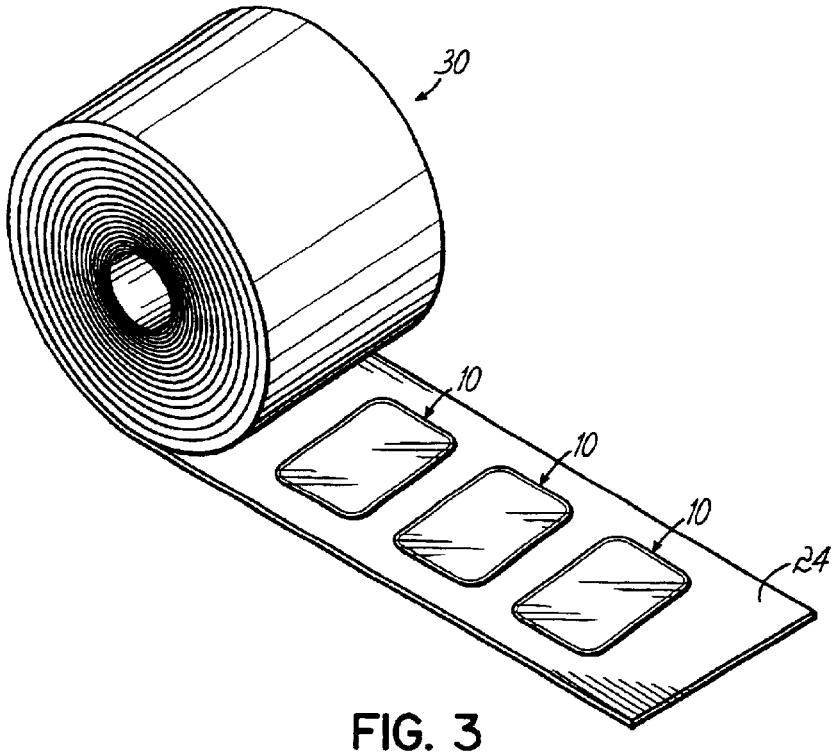
FIG. 3 is a perspective view of a series of thin film labels on a release liner and provided in a roll.

The release liner 24 may be of any suitable material, such as polyester film, and generally has a thickness of about 1.0 mil. In an exemplary embodiment, the release liner 24 is a polyester film having a thickness of 0.7 mil. The release liner 24 may be provided in an elongated web which supports several individual thin film labels 10. The elongated web of release liner 24 may generally be wound into a roll 30 for convenient storage and dispensing of the thin film labels 10, as depicted in FIG. 3.

Advantageously, the thin film labels 10 of the present invention have a thickness which is much less than conventional thin film labels currently in use. Conventional thin film labels generally have thicknesses greater than 1.0 mil, and typically on the order of 2.0 mils or more. The thinner labels of the present invention provide benefits in the form of improved aesthetic appearance of containers to which the labels are applied and increased durability of the labels. Furthermore, because the label film 12 is thinner than previous thin film labels, more labels 10 may be provided on a given size roll 30 of labels. Accordingly, the rolls 30 will require less frequent replacement when used in conventional label application equipment, thereby improving production efficiency.

The label film 12 comprises a web of polymeric material such as polypropylene, polyethylene, PVC, or other suitable polymeric material. In an exemplary embodiment, the label film 12 is made from biaxially oriented polypropylene.

An exemplary thin film label 10 of the present invention may be made by applying an adhesive 22 to an elongate web of liner material 24, applying label film 12 having a thickness between approximately 0.1 mil and approximately 1.0 mil to the liner 24 and adhesive 22 to form a laminate, selectively applying indica 14, 16 on the label film 12, die cutting the label film 12 to define discrete labels 10 and a matrix of waste material, and stripping the matrix of waste material from the laminate so that only the discrete labels 10 remain on the liner material 24.

Figure 4:
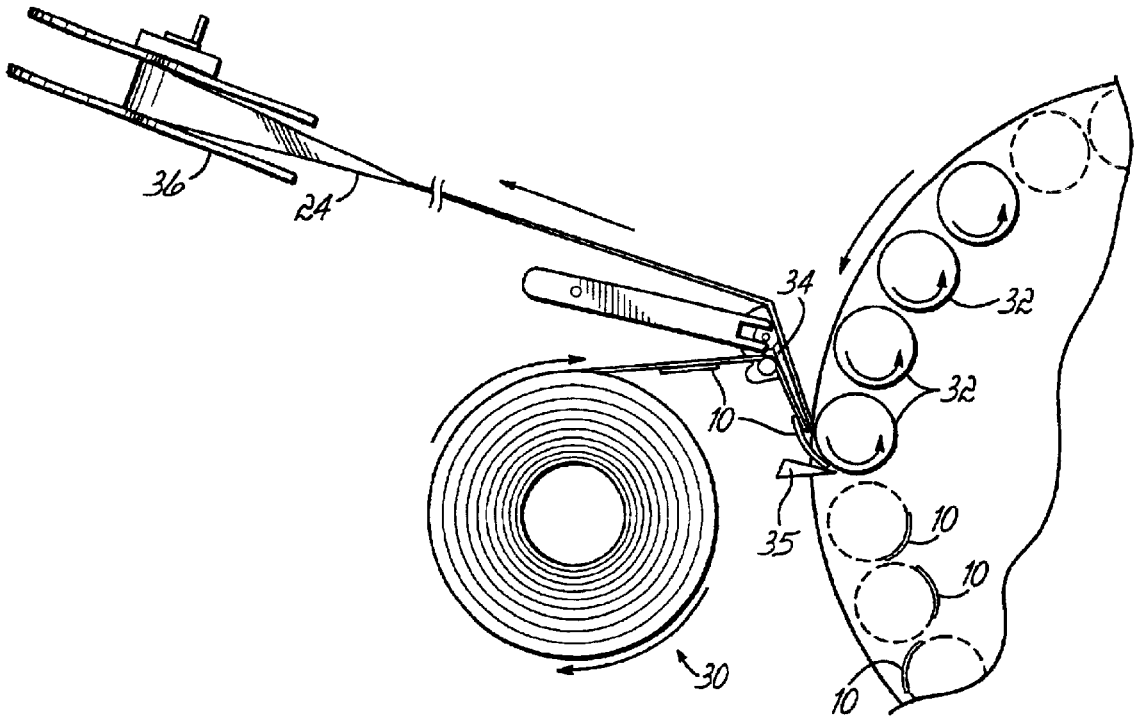
FIG. 4 is a schematic illustration depicting the dispensing and application of thin film labels to containers.

Referring to FIG. 4, an exemplary method of applying a thin film label 10 to a substrate, such as a container 32 will now be described. At least one thin film label 10 having a thickness less than approximately 1.0 mil is provided on a web of liner material 24 wound in a roll 30. The web of liner material 24 is moved over a peel tip 34 to bend the liner material 24, whereby the label 10 is caused to separate from the liner material 24 without tearing the label 10. In an exemplary embodiment, roll 30 is driven by a first motor (not shown) and take-up reel 36 is driven by a second motor (not shown) to move the web of liner material 24 past the peel tip 34 while controlling the tension and speed of the web such that the release value of the adhesive 22 is exceeded when the label 10 passes over the peel tip 34. In addition, rollers may be used on both sides of the peel tip 34 to control the path and/or tension and speed of the web of liner material 24.

A container 32 is placed near the peel tip 34 to receive the label 10 as it is dispensed from the web of liner material 24. The speed of the container 32 relative to the speed of the moving web is controlled such that the container 32 moves slightly faster than the dispensed label 10. A wiper 35 is positioned adjacent peel tip 34 to wipe label 10 as it is applied to container 32 to ensure that no air is trapped between the label 10 and the container 32. The used release liner 24 is wound onto take-up reel 36.

Specific examples of very thin film adhesive labels according to the present invention, and application of the labels to glass bottles, will now be discussed.

EXAMPLE 1

1 mil thick labels were applied to glass bottles on a Spear Model 5000 labeling machine at a rate of about 265 bottles/min. Two label constructions made by FLEXcon Corp., Spencer, Mass., were tested:

Group A: 1.0 mil thick polypropylene film with type A-45 emulsion acrylic adhesive and 1.5 mil thick polyethylene terephthalate (PET) release liner; and Group B: 1.0 mil thick polypropylene film with type A-45 emulsion acrylic adhesive and 2.0 mil thick PET release liner.

1800 samples of each label construction were applied to glass bottles by the labeling machine. All but six labels from Group A and eleven labels from Group B satisfactorily dispensed to the bottles.

EXAMPLE 2

1 mil thick labels were applied to glass bottles on a Krones Autocol labeling machine at a rate of about 265 bottles/min. Two label constructions made by FLEXcon Corp., Spencer, Mass., were tested:

Group A: 1.0 mil thick polypropylene film (Mobil 434) with type A-34 solvent acrylic adhesive and 1.0 mil thick PET release liner; and Group B: 1.0 mil thick polypropylene film (Mobil 434) with type A-32 solvent acrylic adhesive and 1.0 mil thick PET release liner.

A wiping mechanism was used to wipe the labels after being dispensed to the bottles. The wiping mechanism included a 1.5-inch diameter soft foam roller, a 9-inch Teflon-coated soft foam pad, and a brush having long plastic bristles. The peel tip was modified by sharpening the tip to have an end radius of approximately 1/64-inch and the position of the tip was adjusted to form an acute web angle around the tip. 1000 labels from each group were applied to the glass bottles. All labels dispensed satisfactorily. Minor label wrinkles were observed in 25% to 30% of the bottles labeled with Group A labels. Approximately 5% of the bottles labeled with Group B labels were observed to have minor label wrinkles.

EXAMPLE 3

0.7 mil thick labels were applied to glass bottles on a Kosme 960 labeling machine. The labels comprised 1.0 mil thick polypropylene film (Mobil 434) with type A-32 solvent acrylic adhesive and 1.0 mil thick PET release liner made by FLEXcon Corp., Spencer, Mass. All labels were observed to apply satisfactorily to the bottles and it was determined that only minor changes in the wiper were needed for running at production speeds.

As shown in the examples above, the very thin film labels of the present invention, with thicknesses of 1 mil and less, have been demonstrated to be capable of being dispensed to containers by automated equipment and at line speeds compatible for use in conjunction with automated packaging and bottling equipment. The present invention thus overcomes drawbacks of prior art thin film labels which, heretofore, could not be satisfactorily dispensed to containers, such as bottles, when the thickness of the labels was reduced to 1 mil or less. Furthermore, the labels of the present invention were successfully dispensed to bottles without tearing or otherwise distorting appearance of the labels.

While the results described above represent a significant improvement over prior art labels, it will be recognized by those skilled in the art that further improvements in terms of increased application rates, reduced wrinkling, and reduced numbers of non-dispensed labels are possible by making further adjustments to the automated labeling equipment. These types of adjustments are commonly made by operators while the equipment is running, to account for variations in characteristics of different labels and variations in equipment parameters that occur over time.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of applicant's general inventive concept.

What is claimed is:

1. An adhesive coated thin film label, comprising:

label film having a thickness of approximately 0.1 mil to approximately 1.0 mil, the label film being die cut to define a label shape and having a first surface and a second surface opposite said first surface;

an adhesive disposed on one of said first and second surfaces of said label film; and visible indica selectively disposed on at least one of said first and second surfaces to define a viewable label image:

wherein said adhesive has a release value not greater than approximately 15 grams.

2. A supply of thin film labels, comprising:

an elongate web of liner material for supporting labels;

a plurality of discrete die cut labels releasably disposed on said liner material and having a thickness between approximately 0.1 mil and approximately 1.0 mil, each label having a first surface and a second surface opposite said first surface;

an adhesive disposed on one of said first and second surfaces of said plurality of labels, between said labels and said liner material, said adhesive having a release value not greater than approximately 15 grams; and visible indica selectively disposed on at least one of said first end second surfaces to define a viewable label image.

3. The supply of thin film labels of claim 2:

wherein said labels have a thickness of at least approximately 0.1 mil; and wherein said labels have a thickness not greater than approximately 0.9 mil.

4. The supply of thin film labels of claim 2:

wherein said labels have a thickness of at least approximately 0.3 mil; and wherein said labels have a thickness not greater than approximately 0.8 mil.

5. The supply of thin film labels of claim 2 wherein said labels have a thickness of approximately 0.7 mil.

6. A labeled product package, comprising:

a container having a surface for receiving a label; and a label disposed on said surface, said label comprising:

label film having a thickness of approximately 0.1 mil to approximately 1.0 mil, wherein said label film is die cut to define a label shape and has a first surface and a second surface opposite said first surface, an adhesive disposed on one of said first and second surfaces of said label film, said adhesive having a release value not greater than approximately 15 grams, and visible indica selectively disposed on at least one of said first and second surfaces to define a viewable label image.

7. The labeled product package of claim 6:

wherein said label film has a thickness of at least approximately 0.3 mil; and wherein said label film has a thickness not greater than approximately 0.9 mil.

8. The labeled product package of claim 6:

wherein said label film has a thickness of at least approximately 0.5 mil; and wherein said label film has a thickness not greater than approximately 0.8 mil.

9. The labeled product package of claim 6 wherein said label film has a thickness of approximately 0.7 mil.

10. The labeled product package of claim 6 wherein said indica comprises ink.

11. The labeled product package of claim 6 wherein said indica comprises hot stamped foil.

12. The labeled product package of claim 6 wherein said indica is embossed on at least one of said first and second surfaces.

* * * * *